US008974249B2

(12) United States Patent
Zhang

(10) Patent No.: US 8,974,249 B2
(45) Date of Patent: Mar. 10, 2015

(54) ELECTRICAL CONNECTOR

(75) Inventor: Xue-Hai Zhang, Xuzhou (CN)

(73) Assignee: Molex Incorporated, Lisle, IL (US)

( * ) Notice: Subject to any disclaimer, the term of this patent is extended or adjusted under 35 U.S.C. 154(b) by 38 days.

(21) Appl. No.: 13/702,471

(22) PCT Filed: Jun. 7, 2011

(86) PCT No.: PCT/US2011/039369

§ 371 (c)(1),
(2), (4) Date: Feb. 28, 2013

(87) PCT Pub. No.: WO2011/156314

PCT Pub. Date: Dec. 15, 2011

(65) Prior Publication Data

US 2013/0203290 A1 Aug. 8, 2013

(30) Foreign Application Priority Data

Jun. 10, 2010 (CN) ..... 2010 1 0200703

(51) Int. Cl.

| | |
|---|---|
| ***H01R 13/648*** | (2006.01) |
| ***H01R 12/71*** | (2011.01) |
| ***H01R 12/72*** | (2011.01) |
| ***H01R 13/6594*** | (2011.01) |

(52) U.S. Cl.

CPC ..... *H01R 12/716* (2013.01); *H01R 12/724* (2013.01); *H01R 13/6594* (2013.01)

USPC ..... 439/607.4

(58) Field of Classification Search

USPC ..... 439/607.4, 607.35

See application file for complete search history.

(56) References Cited

U.S. PATENT DOCUMENTS

| | | | | |
|---|---|---|---|---|
| 6,827,610 | B2 | 12/2004 | Lin | |
| 7,748,999 | B1 * | 7/2010 | Sun et al. | 439/79 |
| 8,323,057 | B2 * | 12/2012 | Ho | 439/660 |
| 2008/0311801 | A1 | 12/2008 | Chen et al. | |
| 2009/0149045 | A1 | 6/2009 | Chen et al. | |
| 2009/0156027 | A1 | 6/2009 | Chen | |
| 2010/0136830 | A1 | 6/2010 | Chen et al. | |

FOREIGN PATENT DOCUMENTS

| | | | |
|---|---|---|---|
| CN | 201365007 | Y | 12/2009 |
| CN | 201374433 | Y | 12/2009 |

(Continued)

OTHER PUBLICATIONS

International Search Report for PCT/US2011/039369, 2011.

*Primary Examiner* — Phuong Dinh
(74) *Attorney, Agent, or Firm* — Stephen L. Sheldon

(57) ABSTRACT

An electrical connector includes a body with a tongue and the body supports a terminal module, the terminal module including a first row of terminals and a second row of terminals. Each terminal includes a contact portion and a soldering portion, the contact portions of the first and second row of terminals being disposed on an upper side and a lower side of the tongue, respectively, and the soldering portions of the first and second row of terminals each being arranged in a front column and a back column. A first and second positioning element can support the first and second rows of terminals, respectively. A shield that envelopes a periphery of the insulating body forms a contact chamber for accommodating the tongue. The front portion of the shield can be recessed into the circuit board to reduce the effective height of the connector and circuit board.

13 Claims, 12 Drawing Sheets

(56) References Cited

FOREIGN PATENT DOCUMENTS

| | | | |
|---|---|---|---|
| CN | 201374444 | Y | 12/2009 |
| JP | 01-296576 | A | 11/1989 |
| JP | 10-199640 | A | 7/1998 |
| JP | 2000-277193 | A | 10/2000 |
| JP | 2007-227379 | A | 9/2007 |

* cited by examiner

ELECTRICAL CONNECTOR

RELATED APPLICATIONS

This application is a national phase of PCT Application No. PCT/US11/39369, filed Jun. 7, 2011, which claims priority to Chinese Application No. 201010200703.0, filed Jun. 10, 2010, which is incorporated herein by reference in its entirety.

TECHNICAL FIELD

The present invention relates to an electrical connector and, in particular, to an electrical connector suitable for helping to reduce the total height of an electrical connector and a corresponding circuit board.

BACKGROUND

With the fast development of multi-media technique, Mini-Display Port connectors are widely used in electronic devices day by day. To help meet the desire for miniaturized products, Chinese patent ZL200920001857.X discloses an electrical connector comprising an insulating housing which is provided with an accommodating chamber at the rear portion thereof and a tongue protruding forwardly from the front portion thereof; a plurality of terminals, which include an upper row of terminals mounted at the upper side and a lower row of terminals mounted at the lower side of the tongue respectively, each terminal being provided with a contact portion, a soldering portion and a bending portion connected between the contact portion and the soldering portion, the contact portion of the upper row of terminals and the lower row of terminals being mounted on the upper side and lower side of the tongue respectively, and the soldering portions of each row of terminals extend downwards from the rear portion of the insulating housing and are arranged in a front column and a back column; a shielding housing, which envelops at the periphery of the insulating housing; and two positioning modules, which are mounted in the accommodating chamber of the insulating housing and envelop the periphery of the bending portions of the terminals so as to effectively prevent the bending portions of the terminals from being bent or contacting with each other to short circuit failure due to external force. The bottom surface of the front portion of the shielding housing is higher than the bottom surface of the rear portion of the insulating housing for a preset distance, and when the electrical connector is mounted on a circuit board, the bottom surface of the rear portion of the insulating housing contacts against the upper surface of the circuit board first to prevent the electrical connector from further sinking, and the bottom surface of the front portion of the shielding housing is higher than the upper surface of the circuit board for a hanging space.

Therefore, both the insulating housing and the shielding housing of the conventional electrical connector are disposed above the circuit board, so the total height is large, and generally equal to the height of the electrical connector plus the height of the circuit board, which is not suitable to the electronic devices with compact space such as a notebook computer.

SUMMARY OF THE INVENTION

An electrical connector includes an insulating body with a front portion and a tongue protrudes from the front portion. The connector further includes a terminal module which can be mounted on the insulating body and may include a first and second positioning element that can each supports, respectively, a first and second row of terminals. Each terminal can be provided with a contact portion and a soldering portion, the contact portions of the first row of terminals and the contact portions of the second row of terminals being disposed on an upper side and lower side of the tongue, respectively, and the soldering portions of the first row of terminals and the soldering portions of the second row of terminals can each be configured to provide a front column and a back column of soldering portions. The connector can further include a shield which envelopes a periphery of the insulating body and the shield can include a top wall, a bottom wall and two side walls that connect the top and bottom wall so as to form a contact chamber that accommodates the tongue, and the soldering portions of the first and second rows of terminals can extend out of a rear portion of the shield. In addition, a rear portion of the electrical connector can be provided with a support surface for contacting against the circuit board, and the bottom wall at the front portion of the shield is lower than the support surface.

The terminals may each include a bending portion extending from the contact portion and an extending portion extending from the bending portion and the soldering portion extending from the extending portion. The extending portions of the first row of terminals can be spaced apart from the extending portions of the second row of terminals in a vertical direction; and if desired, a protecting element can be disposed between the extending portions of the first row of terminals and the extending portions of the second row of terminals. In an embodiment, the first and second positioning elements can be assembled to each other.

DETAILED DESCRIPTION OF THE PREFERRED EMBODIMENTS

Hereinafter, by taking the mini-DisplayPort cable connector as an example, the embodiments will be described in detail with reference to the accompanying drawings. The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

The electrical connector disclosed herein could reduce the total height of the connector and a corresponding circuit board by the structure provided. For example, the front portion of the shield is designed to recessed into the circuit board, thereby reducing the total height of the connector and the circuit board. As a result, the electrical connector is especially adapted to applications such as the notebook computer with compact space. Furthermore, by providing a bending portion upwardly bending and extending between the contact portion and the extending portion, the front portion of the electrical connector with the contact portion can be recessed into the circuit board, and there is also a proper distance between the extending portion and the circuit board in the up-and-down direction. The shield can be designed to be a two-piece combined structure, which makes it easier to change the depth that the front portion of the shield sinks into the circuit board. In addition, by providing the protecting element, the second row of terminals are prevented from bending upwardly and being short-circuited due to contact with the first row of terminals when an external force is applied on. Furthermore, by providing fixing pins at the first housing and the second housing, the whole electrical connector is fixed to the circuit board under uniform force, therefore, the lifespan of the electrical connector can be prolonged.

Figure 1:
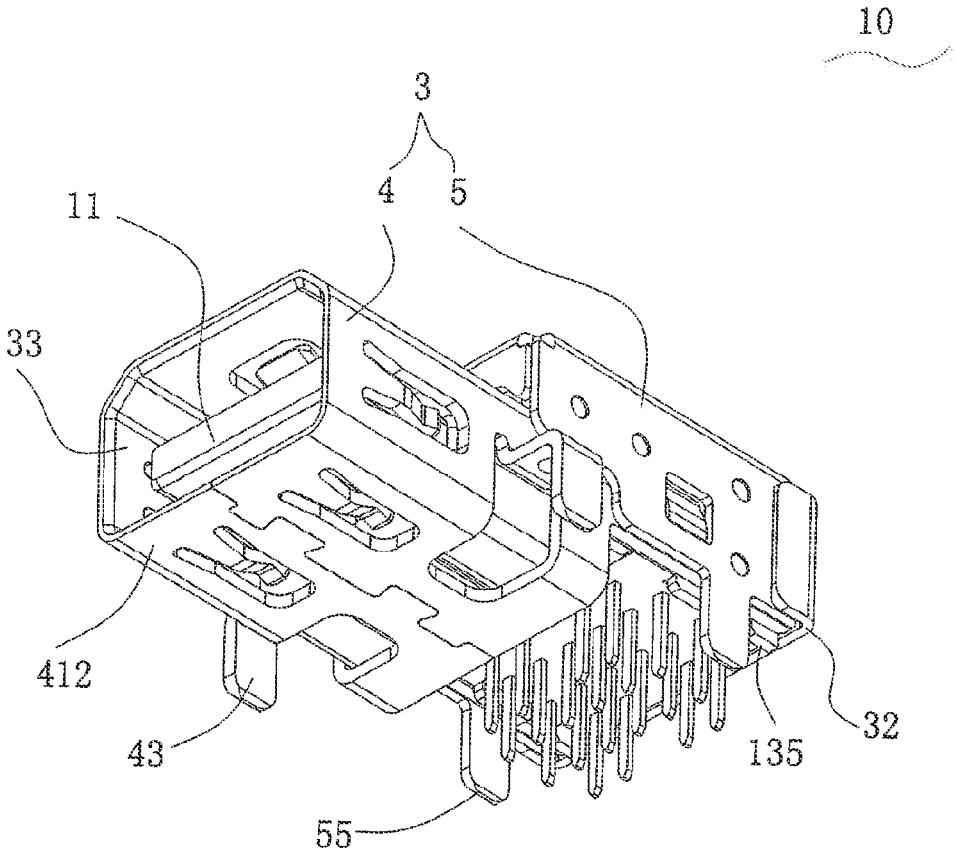
FIG. 1 is a perspective view showing an embodiment of an electrical connector.
Figure 2:
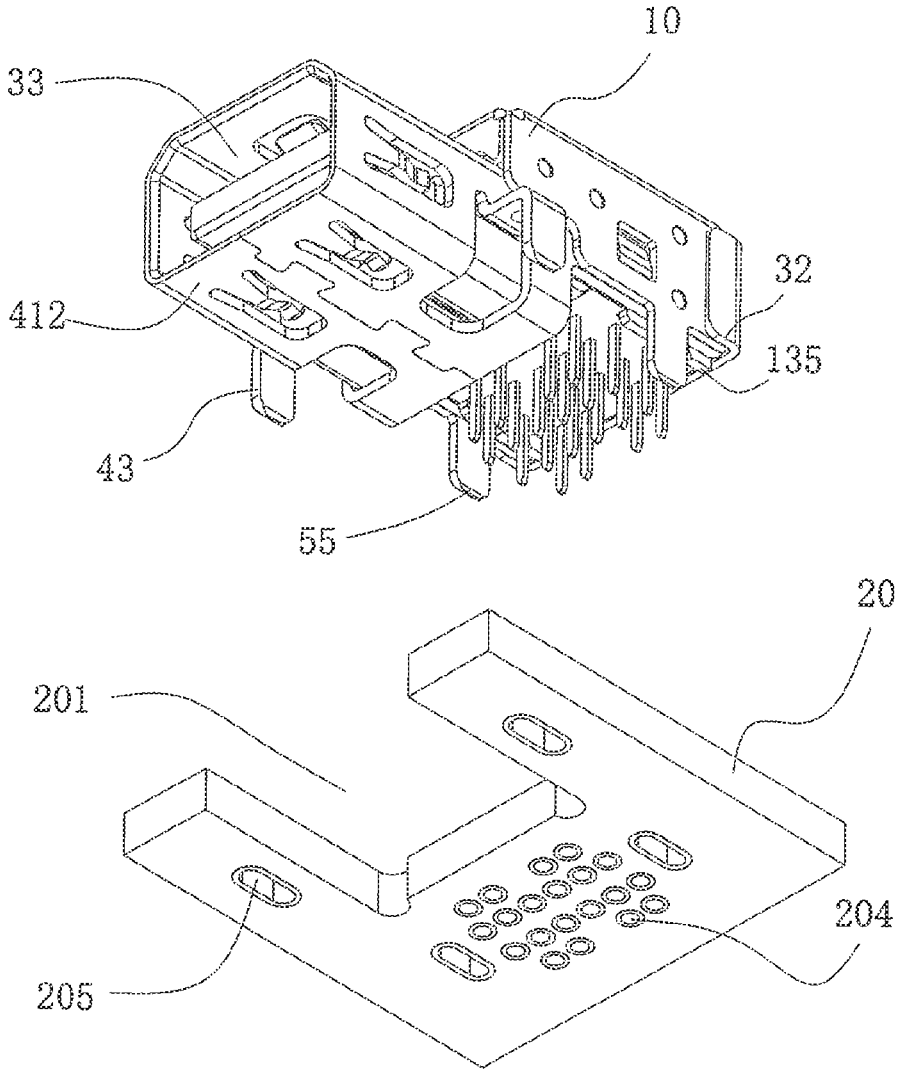
FIG. 2 is an exploded perspective view showing the electrical connector of FIG. 1 assembled to a circuit board.
Figure 3:
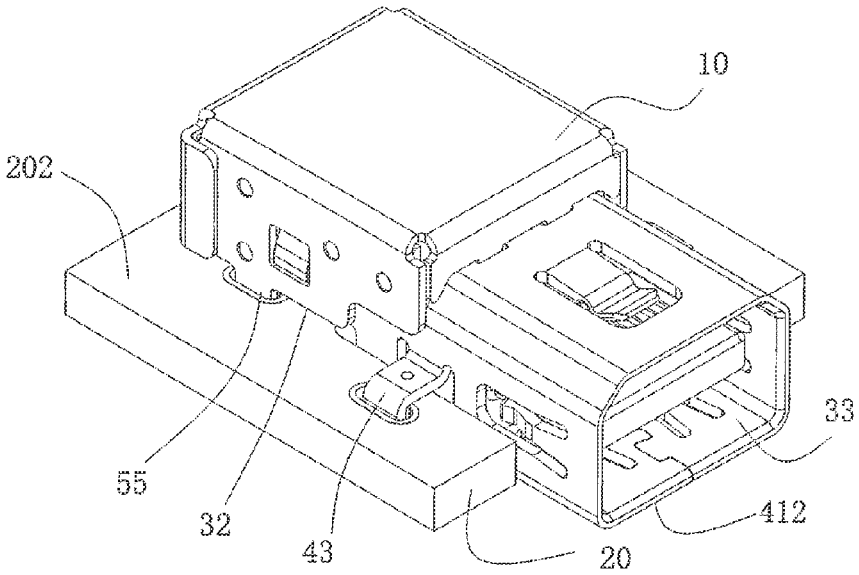
FIG. 3 is a perspective view showing the electrical connector of FIG. 1 assembled to the circuit board.

FIG. 1 to FIG. 12 depict features of an electrical connector 10. The electrical connector 10 includes an insulating body 1, a terminal module 2 mounted on the insulating body 1 and a shield 3 enveloping the periphery of the insulating body 1. As shown in FIG. 2, the electrical connector 10 may be mounted in an accommodating recess 201 of the circuit board 20.

Figure 4:
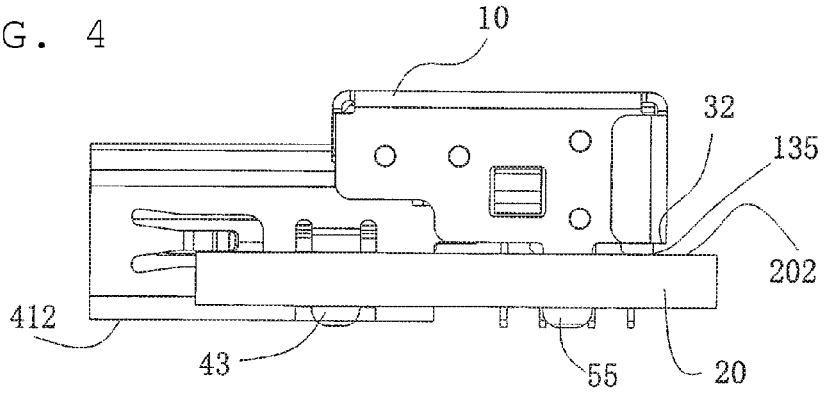
FIG. 4 is a side view showing the electrical connector assembled to the circuit board in FIG. 3.
Figure 5:
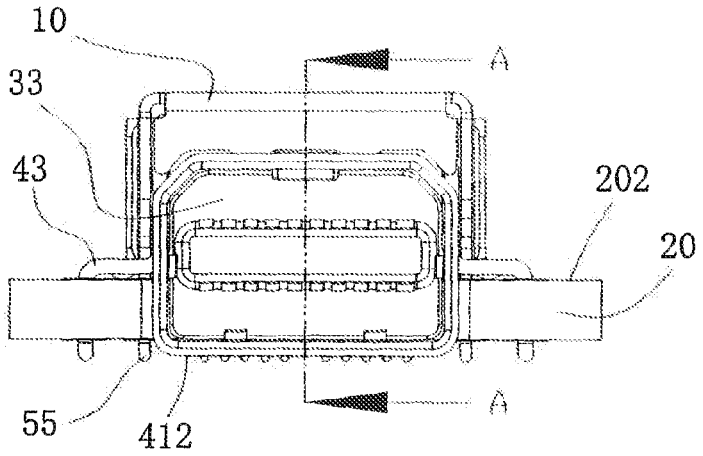
FIG. 5 is a front view showing the electrical connector assembled to the circuit board in FIG. 3.
Figure 6:
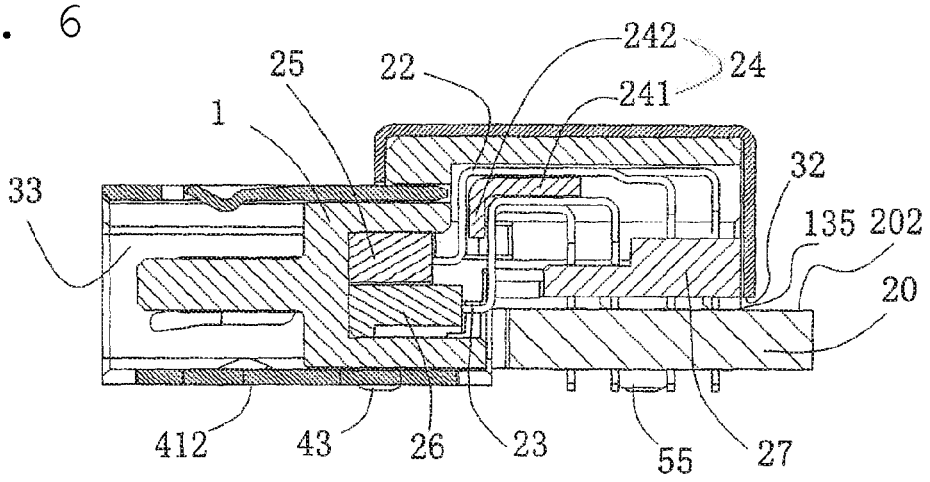
FIG. 6 is a cross-sectional view along line A-A in FIG. 5.
Figure 7:
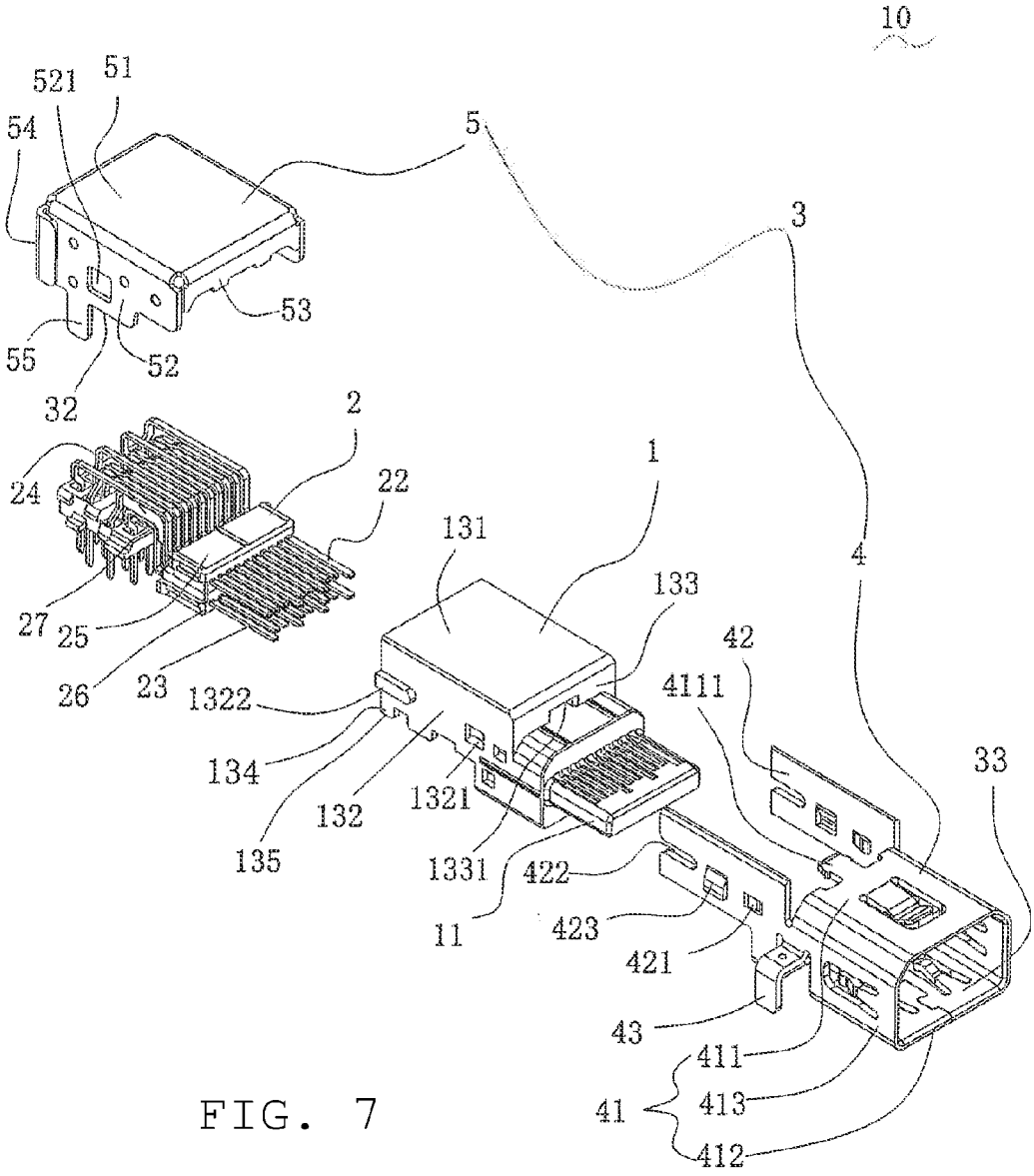
FIG. 7 is an exploded perspective view showing an embodiment of an electrical connector.
Figure 8:
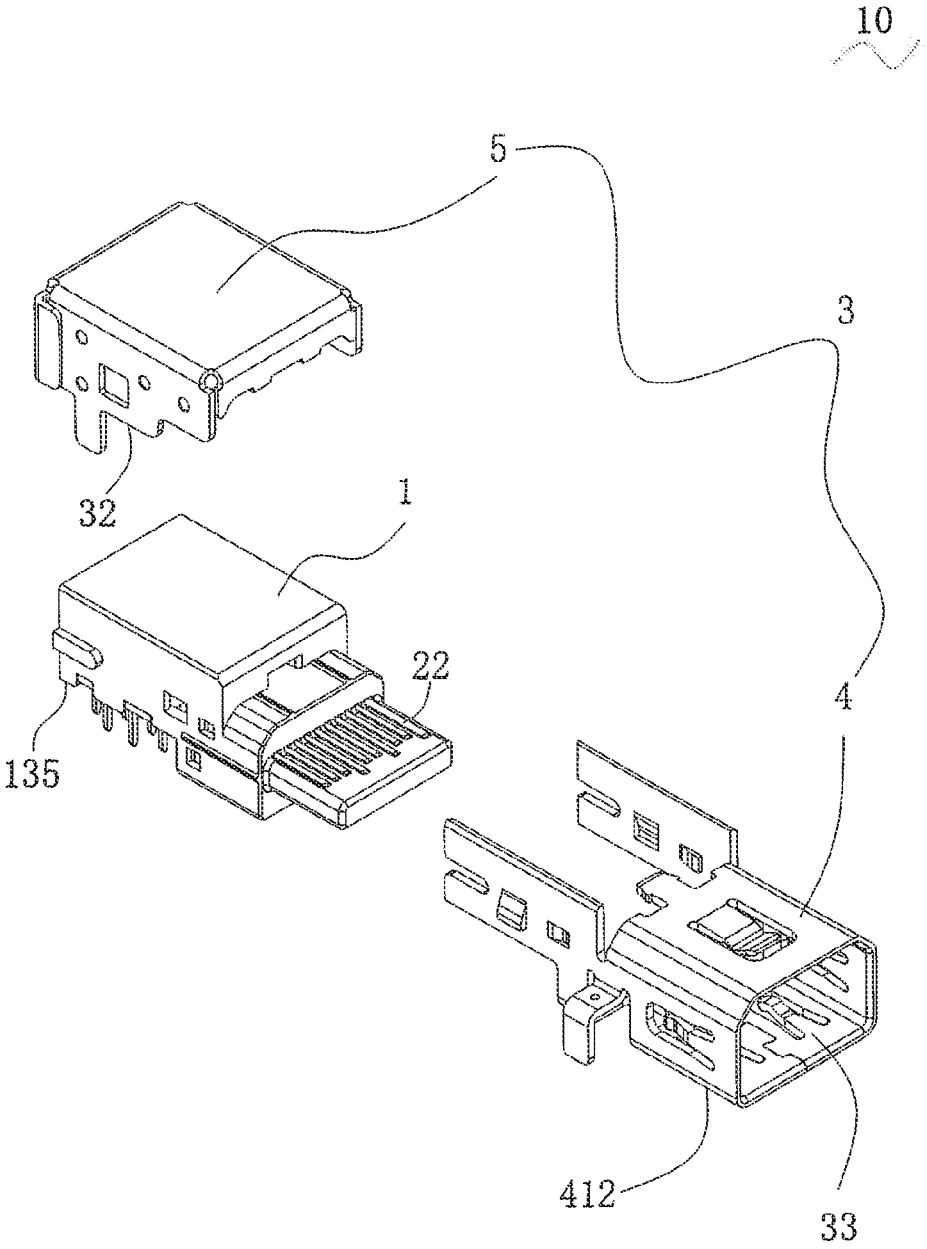
FIG. 8 is an exploded perspective view showing an embodiment of an electrical connector, wherein the terminal module and the insulating body are assembled together.
Figure 9:
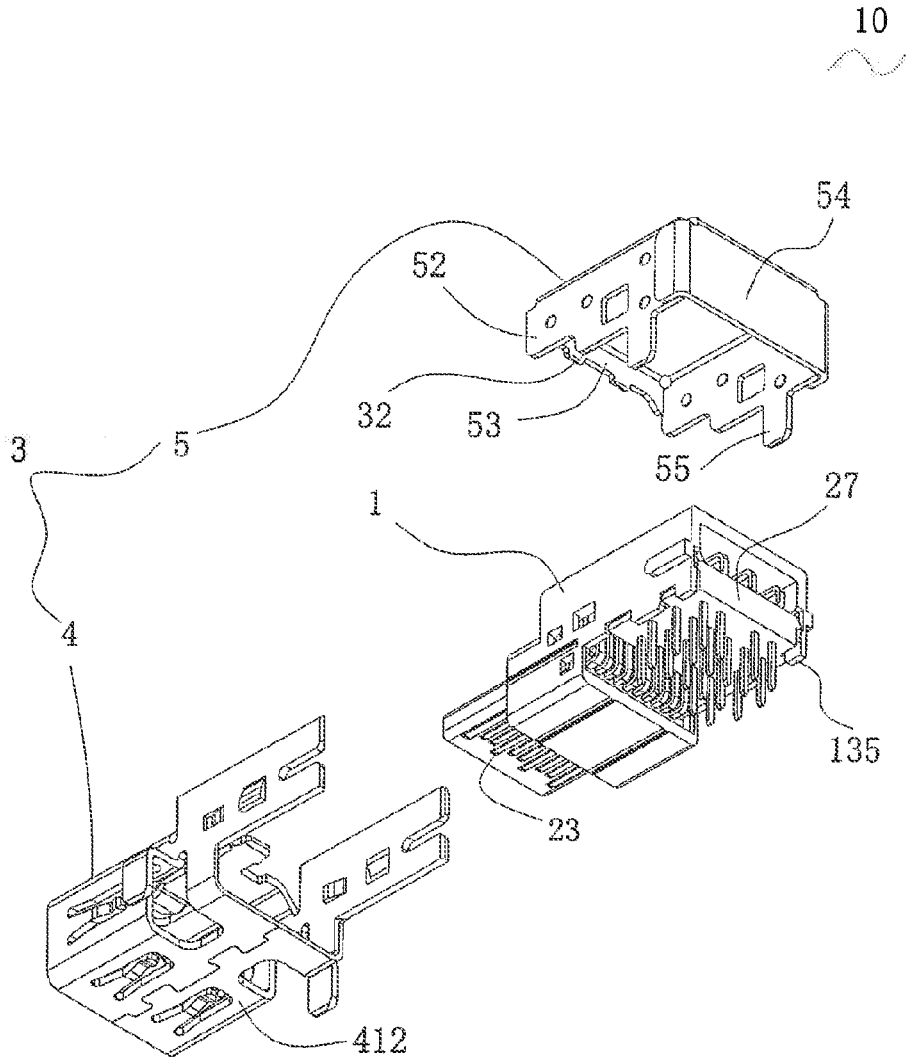
FIG. 9 is another exploded perspective view showing the electrical connector depicted in FIG. 8.
Figure 10:
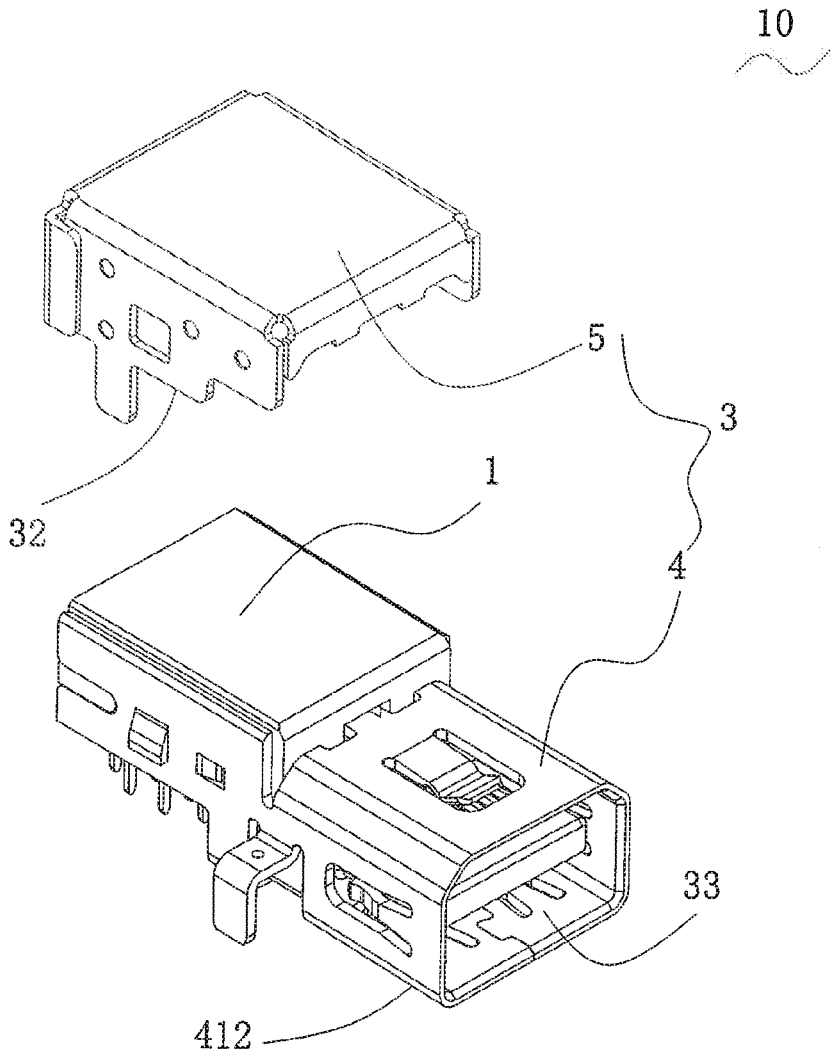
FIG. 10 is an exploded perspective view of an embodiment of an electrical connector.
Figure 11:
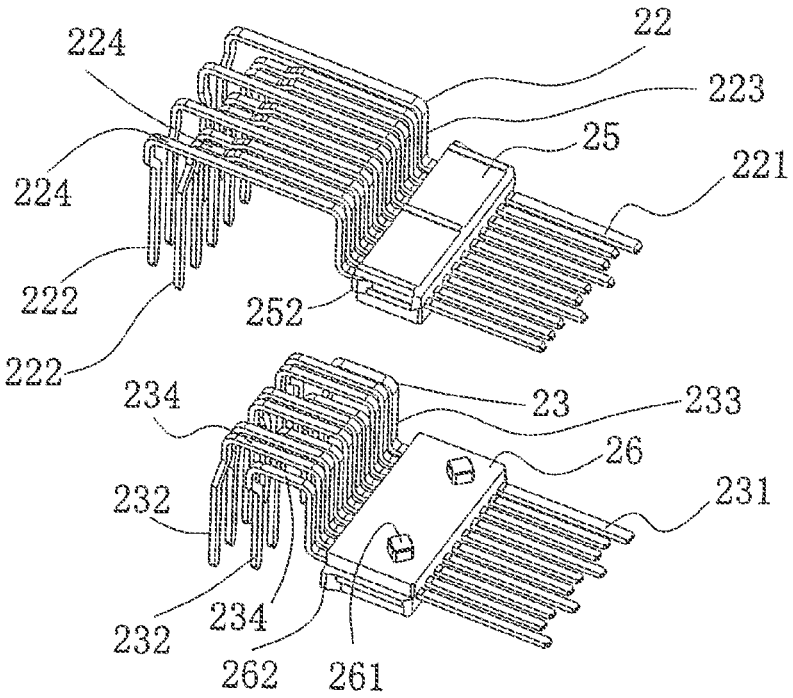
FIG. 11 is an exploded perspective view showing two positioning elements configured to be assembled together.
Figure 13:
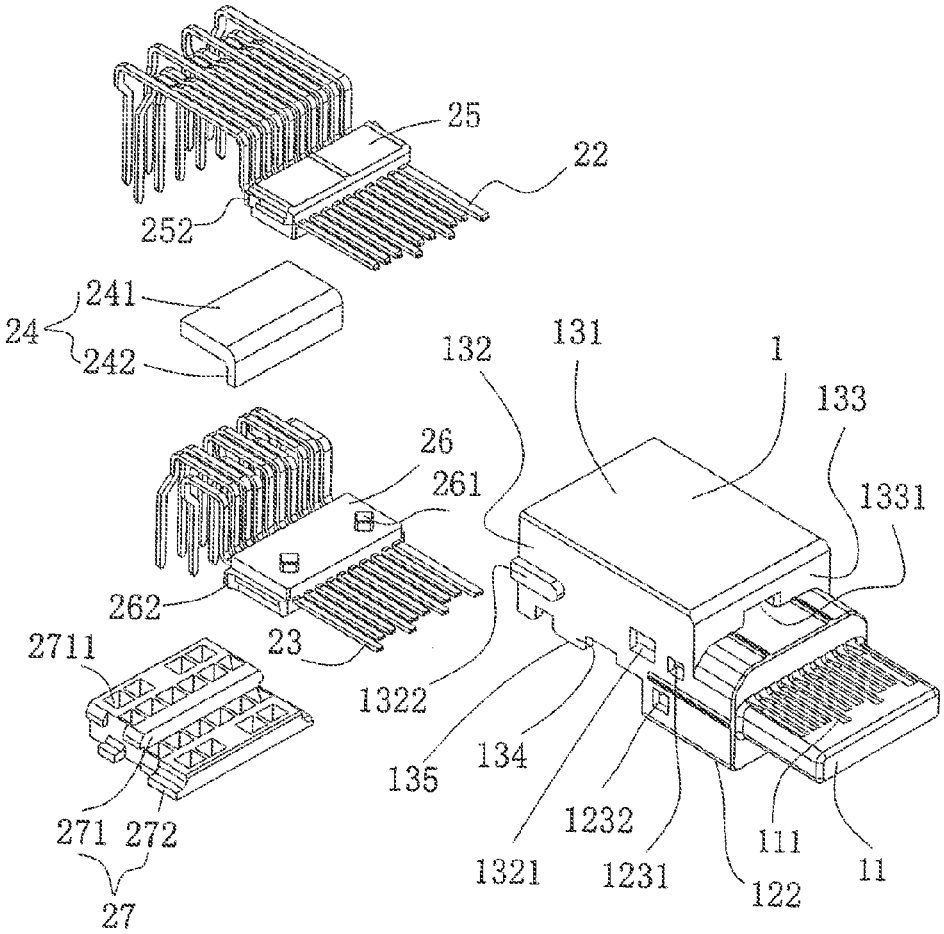
FIG. 13 is an exploded perspective view showing an embodiment of a terminal module and an insulating body of an electrical connector.
Figure 14:
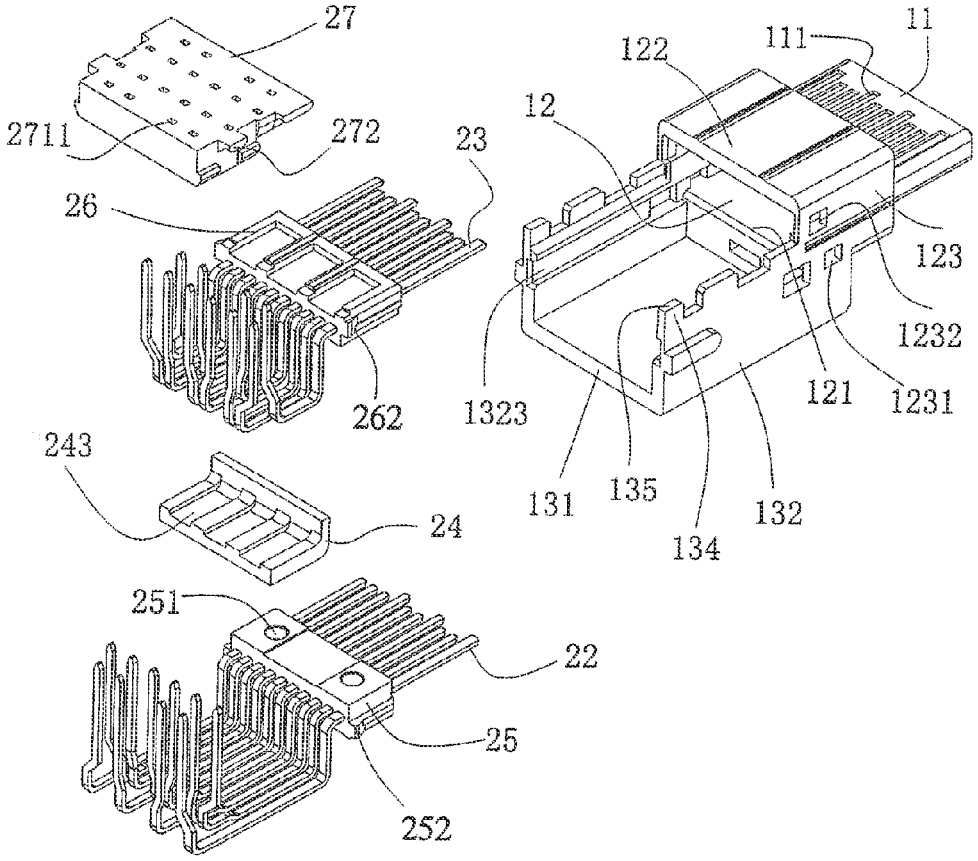
FIG. 14 is another perspective view showing the features depicted in FIG. 13 from another angle of view.
Figure 15:
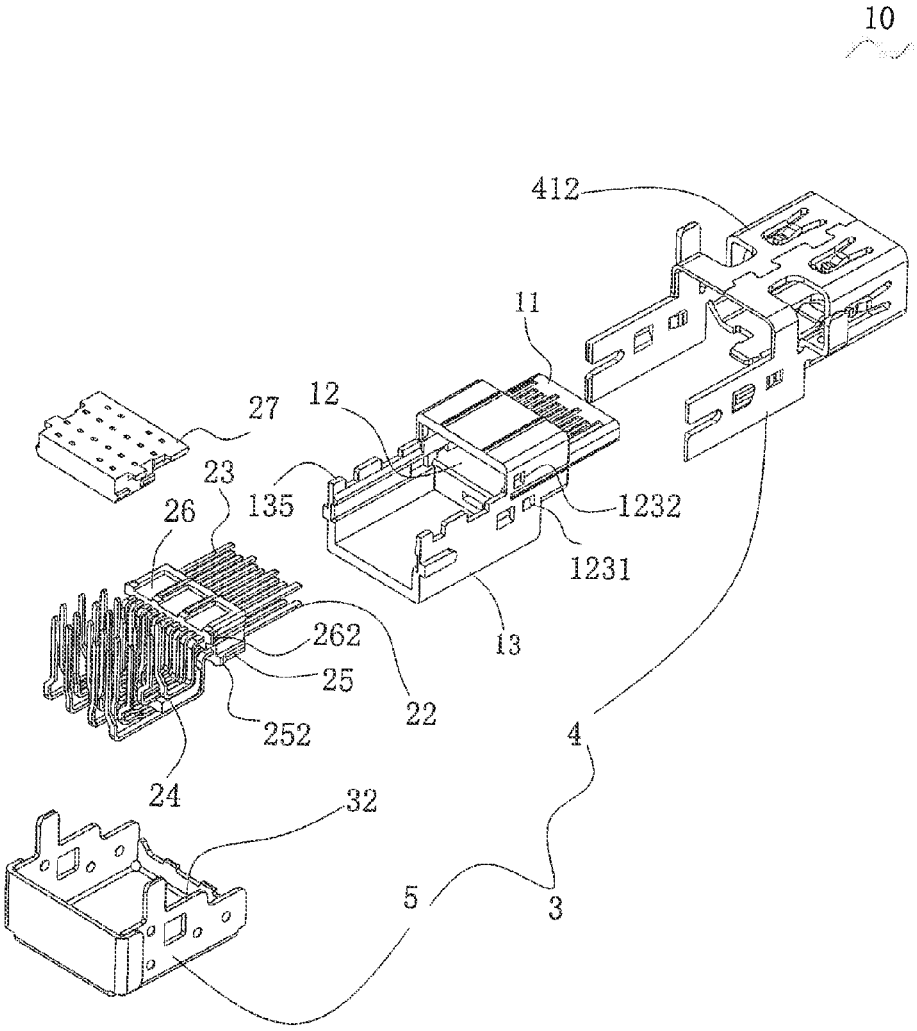
FIG. 15 is an exploded perspective view of an embodiment of an electrical connector.

As depicted in FIGS. 13-15, a tongue 11 protrudes forwardly from a front portion of the insulating housing 1, an accommodating chamber 12 is formed in the middle of the insulating housing 1, and a frame 13 is protrude backwardly and upwardly from the rear portion of the insulating housing 1. A plurality of terminal accommodating grooves 111 are provided at both upper side and the lower side of the tongue 11. The accommodating chamber 12 is formed by an upper wall 121, a lower wall 122 and two side walls 123. The side wall 123 has two fastening holes 1231 and 1232. The frame 13 is formed by an upper wall 131, two side walls 132 and a front wall 133. Each side wall 132 is provided with a fixing hole 1321 at front part thereof, and a fixing block 1322 protruding at rear part thereof and extending in a fore-and-aft direction; besides, the inner part of each side walls 123 is recessed with a fixing slot 1323 which extends in a fore-and-aft direction. The front wall 133 is provided with a through slot 1331 which extends and penetrates from front to back. Two supporting pins 134 are protruded downwardly from the bottom of the two side walls 132 respectively. Each bottom of the supporting pins 134 has a support surface 135. As shown in FIG. 4, when the electrical connector 10 is mounted into the accommodating recess 201 of the circuit board 20, the support surface 135 contacts against the upper surface 202 of the circuit board 20 as long as the electrical connector 10 is sunk to a preset depth, so as to prevent the electrical connector 10 from further sinking, which facilitates the subsequent soldering process.

As shown in FIG. 11 to FIG. 15, the terminal module 2 includes a first positioning element 25 which supports a first row of terminals 22 and a second positioning element 26 which supports a second row of terminals 23. A protecting element 24 is mounted between the two rows of the terminals 22 and 23 and a spacing element 27 may be provided adjacent soldering portions of the terminals.

Each of the first row of terminals 22 is provided with a contact portion 221, a bending portion 223 upwardly bending and extending from the rear end of the contact portion 221, and an extending portion 224 further backwardly bending and extending from the upper edge of the bending portion 223, and a soldering portion 222 further downwardly bending and extending from the rear end of the extending portion 224. Each of the second row of terminals 23 is also provided with a contact portion 231, a bending portion 233 upwardly bending and extending from the rear end of the contact portion 231, an extending portion 234 backwardly bending and extending from the upper edge of the bending portion 233, a soldering portion 232 further downwardly bending and extending from the rear end of the extending portion 234. Thus, the terminals each are formed in a U-shaped bend. Also referring to FIG. 6, since bending portions 223, 233 upwardly bending and extending from the contact portion 221, 231 are positioned between the contact portions 221, 231 and the extending portions 224, 234, the contact portions 221, 231 are located at a lower position and the extending portions 224, 234 are located at a higher position. Therefore, the front portion of the electrical connector 10 where the contact portions 221, 231 are positioned can be sunk into the accommodating recess 201 of the circuit board 20, and there is a suitable distance between the extending portions 224, 234 and the circuit board 20 in the up-and-down direction. The contact portions 221, 231 of the two rows of terminals 22, 23 are mounted in the accommodating grooves 111 at the upper and lower sides of the tongue 11, and the soldering portions 222, 232 of the two rows of the terminals 22, 23 are each arranged in a front column and a back column so as to provide a total of four columns. The bending portion 223 of the terminal 22 is spaced apart from the bending portion 233 of the terminals 23 in the fore-and-after direction, and the extending portion 224 of the terminal 22 is spaced apart from the extending portion 234 of the terminals 23 in the up-and-down direction.

Figure 12:
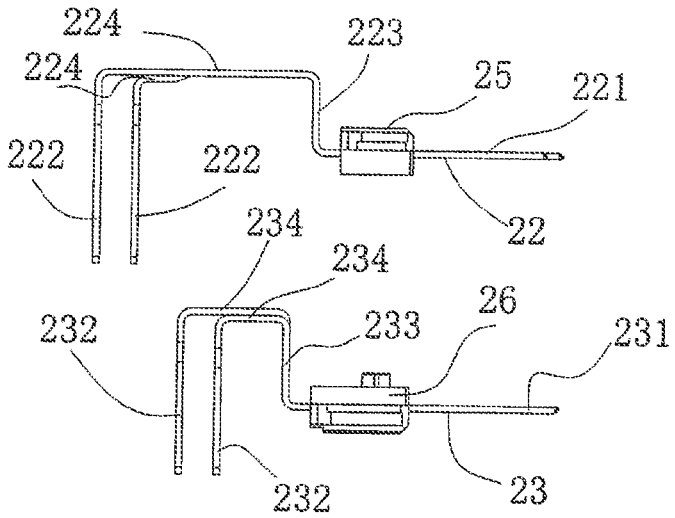
FIG. 12 is an elevated side view of the position elements shown in FIG. 11.

As shown in FIG. 12, in the first row of terminals 22, there is a height difference in the up-and-down direction between the rear portions of the extending portions 224 of the terminals whose soldering portions 222 are at the front column and the rear portions of the extending portions 224 of the terminals whose soldering portions 222 are at the back column The height difference is equal to the thickness of the extending portion 224. In the second row of terminals 23, there is a height difference in the up-and-down direction between the extending portions 234 of the terminals whose soldering portions 232 are at the front column and the rear portions of the extending portions 234 of the terminals whose soldering portions 232 are at the back column, and the height difference is also equal to the thickness of the extending portion 234.

The protecting element 24 is made of insulating materials, and includes a horizontal portion 241 and a vertical portion 242. The horizontal portion 241 is correspondingly disposed between the extending portions 224 and 234 of the first and second row of the terminals 22 and 23. The vertical portion 242 is disposed between the bending portions 223 and 233 of two rows of the terminals 22 and 23. A plurality of recesses 243 are provided at the bottom of the protecting element 24 for accommodating the extending portions 234 of the second row of terminals 23. When forwardly inserting and assembling the terminal module 2 (which does not include the spacing element 27) to the accommodating chamber 12 of the insulating body 1, the vertical portion 242 can prevent the bending portions 223 of the first row of terminals 22 and the bending portions 233 of the second row of terminals 23 from deforming and being short-circuiting. When mounting the electrical connector 10 onto the circuit board 20, the horizontal portion 241 can prevent the extending portion 234 of the second row of terminals 23 from being bended upwardly due to an external force when it is inserted into the bonding pad 204 on the circuit board 20, thereby preventing a short circuit between the extending portions 234 of the second row of terminals 23 and the extending portions 224 of the first row of terminals 22.

The first positioning element 25 is formed by overmolding process at the periphery of the rear part of the contact portions 221 of the first row of terminals 22, and the second positioning element 26 is formed by overmolding process at the periphery of the rear part of the contact portions 231 of the second row of terminals 23. As depicted, the lower surface of the first positioning element 25 is provided with buckling grooves 251, and each of the two side surfaces thereof is provided with a protruding block 252, the upper surface of the second positioning element 26 is protruded with fixing blocks 261, and each of the two side surfaces of the second positioning element 26 is protruded with a protruding block 262. The fixing blocks 261 and the buckling grooves 251 are configured to engage with each other to assemble the two positioning elements 25, 26 together. The protruding blocks 252, 262 are engaged with the fastening holes 1231, 1232 on the side wall 123 of the accommodating chamber 12 to assemble and fix the two positioning elements 25, 26 to the accommodating chamber 12 of the insulating body 1. This assembling structure makes it easier to assemble and fix the terminals 22, 23 to the insulating body 1.

The spacing element 27 is made of insulating material, and envelops at the soldering portion 222, 232. The spacing element 27 includes a base 271 and a plurality of fastening blocks 272 protruded outwardly from the both sides of the base 271. The base 271 is provided with a plurality of through holes 2711 which run through up and down and allow the soldering portion 222, 232 pass through, such that it can prevent the soldering portion 222, 232 from deforming and contacting with each other. The fastening blocks 272 can be inserted into the fixing slots 1323 of the frame 13 of the insulating body 1 so as to assemble the spacing element 27 with the insulating body 1 together.

As shown in FIG. 7 to FIG. 10, the front portion of the shield 3 and is assembled with the insulating body 1 to form a contact chamber 33 which accommodates the tongue 11 therein and has an opening at the front end thereof. The rear portion of the shield 3 is assembled with the insulating body 1 and envelops the periphery of the frame 13. The soldering portions 222, 232 of the two rows of the terminals 22, 23 extend out of the bottom surface 32 at the rear portion of the shield 3 in directly inserting mode. It should be noted that, the soldering portion 222, 232 may extend out of the rear portion of the shield 3 in a surface soldering mode. In the present embodiment, the shield 3 is composed of a first housing 4 and a second housing 5, the first housing 4 forming the front portion of the shield 3, and the second housing forming the rear portion of the shield 3.

The first housing 4 includes a body 41 and two side arms 42 extending from both sides of the rear end of the body 41. The body 41 is formed by a top wall 411, a bottom wall 412 and two side walls 413 connected between the top wall 411 and the bottom wall 412, where the tongue 11 is accommodated. A protruding plate 4111, which is protruded backwardly from the rear end of the top wall 411, may be inserted into the through slot 1331 at the front wall 133 of the frame 13 and fastened with the front wall 133. A fixing plate 421 provided at the front part of each side arm 42 and an opening recess 422 provided at the rear part of each side arm 42 may be engaged with the fixing hole 1321 and the fixing block 1322 at two side walls 132 of the frame 13 respectively, thereby connecting the two side arms 42 with the two side walls 132 of the frame 13. Each side arm 42 is further provided with a fastening portion 423 protruded outwardly. A fixing pin 43 is bended outwardly and downwardly from the rear part of each side wall 413, such that the first housing 4 can be fastened onto the circuit board 20 firmly.

The second housing 5 is formed by a top wall 51, two side walls 52, a front wall 53 and a back wall 54. The profile of the second housing 5 matches that of the frame 13. A fixing hole 521 is provided at each side wall 52 respectively, which is engaged with the fastening portion 423 on the side arm 42 of the first housing 4, thereby assembling the second housing 5 with the first housing 4. A fixing pin 55 is downwardly protruded at the rear part of each side wall 52, such that the second housing 5 can be fastened onto the circuit board 20 firmly.

The manufacturing and assembling process of the electrical connector 10 may include the process steps that are provided below: forming an insulating body 1 by molten plastic material in an injecting molding process; forming two rows of terminals 22 and 23 that form the terminals of the terminal module 2 and the connected metal strip (not shown) and then separately manufacturing two positioning elements 25, 26 in an insert molding process so as to provide the terminal module 2; bending the first and second row of terminals 22, 23 to form soldering portions 222, 232 arranged in two columns in fore-and-aft direction; then positioning the two positioning elements 25, 26 together, and interposing the protecting element 24 between the two rows of terminals 22, 23 at the same time so as assemble the terminal module 2 (without the spacing element 27) together and then to the insulating body 1 from back to front; mounting the spacing element 27 into the frame 13 of the insulating body 1 from bottom to top; enveloping the first housing 4 of the shield 3 to the insulating body 1 from the front of the insulating body 1 to back until two side arms 42 are fastened to the two side walls 132 of the frame 13 of the insulating body 1; afterwards, enveloping the second housing 5 of the shield 3 to the frame 13 of the insulating body 1 from top to bottom until the fixing holes 521 at the two side walls 52 of the second housing 5 are engaged with the fastening portions 423 at the side arms 42 of the first housing 4, thereby assembling the second housing 5 with the first housing 4.

It should be noted that that the process of manufacturing the first positioning element to the first row of terminals, the terminals whose soldering portions 222 are arranged at the front column and the terminals whose soldering portions 222 are arranged at the rear column can be formed in different rows of metal strips in a stamping process. By providing a height difference between the rear parts of two columns of extending portion 224 of the terminals, which can be equal to the thickness of the extending portion 224, it is easier to overlap two rows of metal strips with each other and mold the first positioning element 25 on the periphery at the rear part of two columns of the contact portion 221 of the terminals. As can be appreciated, the molding process of the second positioning element 26 can be similar to that of the first positioning element 25.

FIG. 2 to FIG. 6 show the assembly and application of the electrical connector 10 and the circuit board 20. It can be seen that the bottom wall 412 of the shield 3 at the front portion of the electrical connector 10 is lower than the support surface 135 of the insulating body 1, the first housing 4 as the front portion of the shield 3 can be sunk into the accommodating groove 201 of the circuit board 20, and the support surface 135 of the electrical connector 10 contacts against the upper surface 202 of the circuit board 20 to prevent the electrical connector 10 from being further sunk. This assembled structure makes good use of the height of the circuit board 20, and the total height thereof equals to that of the electrical connector 10. As can be appreciated, the total height is reduced by an amount that is equivalent to the height of the circuit board 20, thus space is saved.

Consequentially, the recessed structure of the electrical connector 10 can reduce the total height of the electrical connector 10 and the circuit board 20, and therefore, it is especially beneficial for compact designs such as notebook computer with compact space requirements. Furthermore, by providing a protecting element 24 between the bending portions 223 and the extending portions 224 of the first row of terminals 22 and the bending portions 233 and the extending portions 234 of the second row of terminals 23, the second row of terminals 23 and the first row of terminals 22 may be prevented from deforming and being short circuited during the assembling process. Moreover, by providing a distance between the extending portions 224 of the first row of terminals 22 and a distance between the extending portions 234 of the second row of terminals 23, which is respectively equal to the thickness of the extending portions 224, 234, it is easier to mold the first and second positioning elements 25 and 26. By configuring the shield 3 as an assembling structure having two housings 4 and 5, it is not only convenient to punch the complex shield 3, but also easy to change the sinking depth of the front portion of the electrical connector 10 just by changing the punching mold of the second housing 5, without changing the punching mold of the first housing 4. Furthermore, by providing the fixing pin 43 in the first housing 4 and the fixing pin 55 in the second housing 5 and soldering the fixing pins 43, 55 in the bonding pad 205 of the circuit board 20, the electrical connector 10 fixed to the circuit board 20 would be subjected to uniform force, thereby prolonging the lifespan of the electrical connector 10.

The above illustrations are merely exemplary. For example, in a preferred embodiment, the support surface 135 is disposed at the bottom of the rear part of the electrical connector 10, however, in other embodiments (not shown), the support surface also may be disposed at the bottom of the rear part of the shield 3 of the electrical connector 10 (such as partially thickening the upper part of the fixing pin 55 of the second housing 5 to make the upper part of the fixing pin 55 unable to pass through the bonding pad 205, therefore the support surface contacts against the upper surface 202 of the circuit board 20 to help prevent the electrical connector 10 from being further recessed). The disclosure provided herein describes features in terms of preferred and exemplary embodiments thereof. Numerous other embodiments, modifications and variations within the scope and spirit of the appended claims will occur to persons of ordinary skill in the art from a review of this disclosure.

What is claimed is:

1. An electrical connector, comprising:

an insulating body with a front portion, the insulating body including a tongue protruded forwards from the front portion;

a terminal module mounted to the insulating body, the terminal module including a first row of terminals and a second row of terminals, each terminal being provided with a contact portion and a soldering portion, the contact portions of the first row of terminals and the contact portions of the second row of terminals being disposed at an upper side and a lower side of the tongue, respectively, the soldering portions of the first row of terminals and the second row of terminals each being arranged in a front column and a back column so as to provide four columns; and a shield with a top wall, a bottom wall and two side walls connected therebetween, the top wall, bottom wall and two side walls extending around a periphery of the insulating body so as to form a contact chamber for accommodating the tongue correspondingly, wherein the soldering portions of the first and second rows of terminals extending out of rear portion of the shield, wherein the shield includes a support surface configured to be supported on a circuit board and the bottom wall at the front portion of the shield is lower than the support surface wherein each terminal further comprises a bending portion upwardly bending and extending from rear end of the contact portion and an extending portion backwardly bending and extending from the bending portion, and the soldering portion is downwardly bending and extending from rear end of the extending portion so as to provide a U-shaped configuration and wherein the extending portions of the first row of terminals are spaced apart from the extending portions of the second row of terminals in an up-and-down direction; and the terminal module further comprises a protecting element which is made of insulating material and disposed between the extending portions of the first row of terminals and the extending portions of the second row of terminals and wherein the bending portions of the first row of terminals are spaced apart from the bending portions of the second row of terminals in a fore-and-aft direction; the protecting element comprises a horizontal portion, which is disposed between the extending portions of the first row of terminals and the extending portions of the second row of terminals, and a vertical portion, which is disposed between the bending portions of the first row of terminals and the bending portions of the second row of terminals.

2. The electrical connector according to claim 1, wherein bottom surface of the protecting element is provided with a plurality of recesses in which the extending portions of the second row of terminals are accommodated.

3. The electrical connector according to claim 1, wherein the terminal module further comprises a first positioning element formed at periphery of rear part of the contact portions of the first row of terminals and a second positioning element formed at periphery of rear part of the contact portions of the second row of terminals.

4. The electrical connector according to claim 3, wherein in the first row of terminals a height difference in an up-and-down direction, which is equal to the thickness of the extending portion, is formed between rear portions of the extending portions of the terminals whose soldering portions are at the front column and rear portions of the extending portions of the terminals whose soldering portions are at the back column.

5. The electrical connector according to claim 4, wherein middle portion of the insulating body is provided with an accommodating chamber in which the first positioning element and the second positioning element are accommodated.

6. The electrical connector according to claim 1, wherein rear portion of the insulating body is provided with a frame which includes an upper wall and two side walls downwardly extending from two sides of the upper walls, the support surface is disposed at bottom of the two side walls of the frame.

7. The electrical connector according to claim 1, wherein the electrical connector is fixed to the circuit board in a recessed manner, the circuit board being provided with an accommodating recess into which the front portion of the shield of the electrical connector is positioned.

8. The electrical connector according to claim 7, wherein the support surface of the electrical connector is disposed at bottom of a rear part of the shield and the support surface is configured to contact the circuit board when the electrical connector is recessed a preset depth so as to prevent the electrical connector from being further recessed.

9. The electrical connector of claim 7, wherein the support surface of the electrical connector is disposed at bottom of the insulative housing and the support surface is configured to contact the circuit board when the electrical connector is recessed a preset depth so as to prevent the electrical connector from being further recessed.

10. An electrical connector, comprising:

an insulating body with a front portion, the insulating body including a tongue protruded forwards from the front portion;

a terminal module mounted to the insulating body, the terminal module including a first row of terminals and a second row of terminals, each terminal being provided with a contact portion and a soldering portion, the contact portions of the first row of terminals and the contact portions of the second row of terminals being disposed at an upper side and a lower side of the tongue, respectively, the soldering portions of the first row of terminals and the second row of terminals each being arranged in a front column and a back column so as to provide four columns; and a shield with a top wall, a bottom wall and two side walls connected therebetween, the top wall, bottom wall and two side walls extending around a periphery of the insulating body so as to form a contact chamber for accommodating the tongue correspondingly, wherein the soldering portions of the first and second rows of terminals extending out of rear portion of the shield, wherein the shield includes a support surface configured to be supported on a circuit board and the bottom wall at the front portion of the shield is lower than the support surface, wherein the shield comprises a first housing forming the front portion of the shield and a second housing forming the rear portion of the shield.

11. The electrical connector according to claim 10, wherein the insulating body is provided with a through slot extending in a fore-and-aft direction; the first housing comprises a body and two side arms extending backwardly from the body, the body is formed by the top wall, bottom wall and two side walls at the front portion of the shield, and rear end of the top wall is provided with a protruding plate which is inserted into the through slot of the insulating body, and the two side arms are fastened with both sides of the insulating body.

12. The electrical connector according to claim 11, wherein two side arms of the first housing are provided with outwards protruded fastening portions respectively; the second housing comprises a top wall and two side walls, and the two side walls of the second housing are provided with fixing holes respectively, the fixing holes of the second housing and the fastening portions of the first housing cooperating with each other to assemble the two housings with each other.

13. The electrical connector according to claim 10, wherein both sides of the first housing and the second housing are provided with fixing pins for being fixed to the circuit board.

* * * * *